US011446793B2

(12) United States Patent
Tan

(10) Patent No.: US 11,446,793 B2
(45) Date of Patent: Sep. 20, 2022

(54) DRIVING TOOL

(71) Applicant: Yu-Tung Tan, Taichung (TW)

(72) Inventor: Yu-Tung Tan, Taichung (TW)

( * ) Notice: Subject to any disclaimer, the term of this patent is extended or adjusted under 35 U.S.C. 154(b) by 212 days.

(21) Appl. No.: 16/986,886

(22) Filed: Aug. 6, 2020

(65) Prior Publication Data

US 2022/0040826 A1 Feb. 10, 2022

(51) Int. Cl.
*B25B 13/46* (2006.01)
*B25B 23/16* (2006.01)

(52) U.S. Cl.
CPC ..... *B25B 13/462* (2013.01); *B25B 23/16* (2013.01)

(58) Field of Classification Search
None
See application file for complete search history.

(56) References Cited

U.S. PATENT DOCUMENTS 6,722,232 B1 * 4/2004 Day ..... B25B 13/467 81/57.39
7,628,098 B2 * 12/2009 Kimberly ..... B25B 17/00 81/57.13
9,868,190 B2 * 1/2018 Yang ..... B25G 1/005
9,868,191 B2 * 1/2018 He ..... B25B 21/00
2005/0155468 A1 * 7/2005 Chu ..... B25G 1/063 81/177.8

FOREIGN PATENT DOCUMENTS

TW I627028 B 6/2018
TW M590508 U 2/2020
TW I690394 B 4/2020

* cited by examiner

*Primary Examiner* — Brian D Keller
(74) *Attorney, Agent, or Firm* — Muncy, Geissler, Olds & Lowe, P.C.

(57) ABSTRACT

A driving tool is provided, including a grip body, a main body, a driving assembly, a press handle, a driven member and a toothed bar. The main body is rotatably disposed on the grip body. The driving assembly is arranged on the main body. The press handle is disposed on the grip body to drive the driven assembly. The driven assembly is disposed on the main body. The toothed bar is connected to the driven assembly and the driving assembly.

9 Claims, 10 Drawing Sheets

DRIVING TOOL

BACKGROUND OF THE INVENTION

Field of the Invention

The present invention relates to a driving tool.

Description of the Prior Art

Conventionally, when using a driving tool for screwing, such as a wrench, to screw a fastener, it requires a greater space, and a user needs to pull the fastener off after pulling for a certain extent and to readjust the angle to pull again. The process is inconvenient and time-consuming.

Therefore, a reciprocating ratchet head is developed for users to pull the wrench back and forth in a small range without having to readjust the angle. This type of reciprocating ratchet head is provided in TWI690394 and TWM590508. In addition, other people even developed a non-screwing way to drive the driving tool, such as TWI627028. A tool head is driven to rotate through pressing, so the fastener can be quickly screwed.

However, there are still some disadvantages to actuate the driving tool through pressing. For example, when using the driving tool, the user has to follow a pressing direction to operate the driving tool. If the user isn't used to the default operation direction, or when the user has to operate the driving tool in a special angle due to the environment, it would be inconvenient and unsmooth for the user to use the driving tool.

The present invention has arisen to mitigate and/or obviate the afore-described disadvantages.

SUMMARY OF THE INVENTION

The major object of the present invention is to provide a driving tool, in which relative positions of components can be adjusted according to the requirements of users, so an operation way of a press-type driving tool can be effectively improved to satisfy all kinds of needs.

To achieve the above and other objects, a driving tool is provided, including a grip body, a main body, a driving assembly, a press handle, a driven assembly and a toothed bar. The main body is rotatably disposed on the grip body, and the main body includes a body portion and a head portion which is connected to the body portion. The driving assembly is received within the grip body, the driving assembly includes a first driving member, a second driving member and an unidirectional rotating structure, the first driving member has a first driving toothed portion which is annular, the second driving member has a second driving toothed portion which is annular, the first driving member and the second driving member are rotatably and coaxially arranged in the grip body and the first driving member is connected to the second driving member via the unidirectional rotating structure, when the first driving member rotates in a rotation direction, the second driving member can be driven to rotate via the unidirectional rotating structure, when the first driving member rotates in a direction counter to the rotation direction, the second driving member is not driven to rotate synchronously via the unidirectional rotating structure. The driven assembly includes at least one driven member, the at least one driven member has a driven toothed portion which is annular, and the at least driven member is rotatably disposed in the head portion. The toothed bar is disposed through the body portion, two opposite ends of the toothed bar respectively project into the head portion and the grip body, the two opposite ends of the toothed bar respectively have a first transmitting toothed portion and a second transmitting toothed portion which are annular, the first transmitting toothed portion is meshed with the driven toothed portion of the at least one driven member, and the second transmitting toothed portion is meshed with the second driving toothed portion of the second driving member. The press handle is movably disposed on the grip body, the press handle includes a driven toothed row, and the driven toothed row is meshed with the first driving toothed portion of the first driving member so as to drive the first driving member to rotate through a movement of the press handle.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
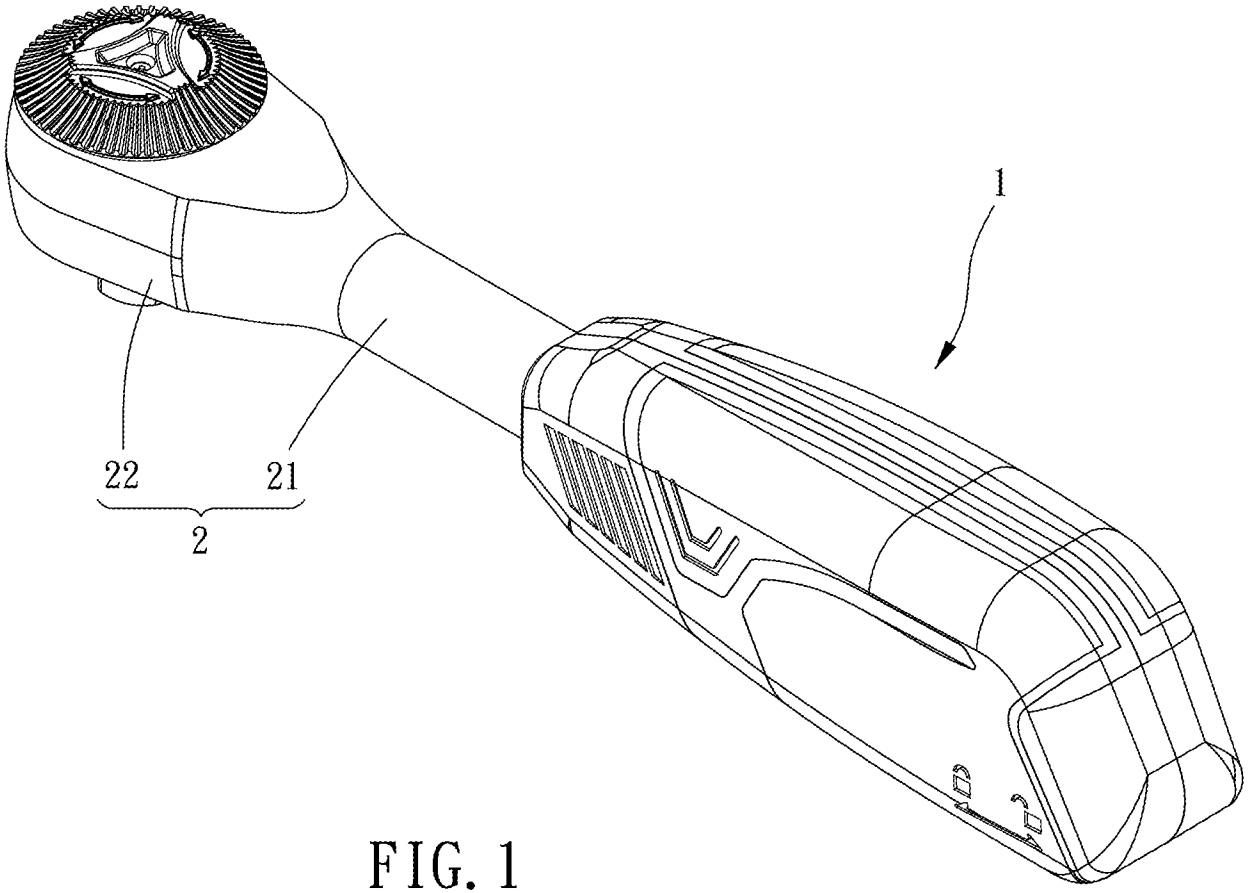
FIG. 1 is a stereogram of a first embodiment of the present invention.
Figure 2:
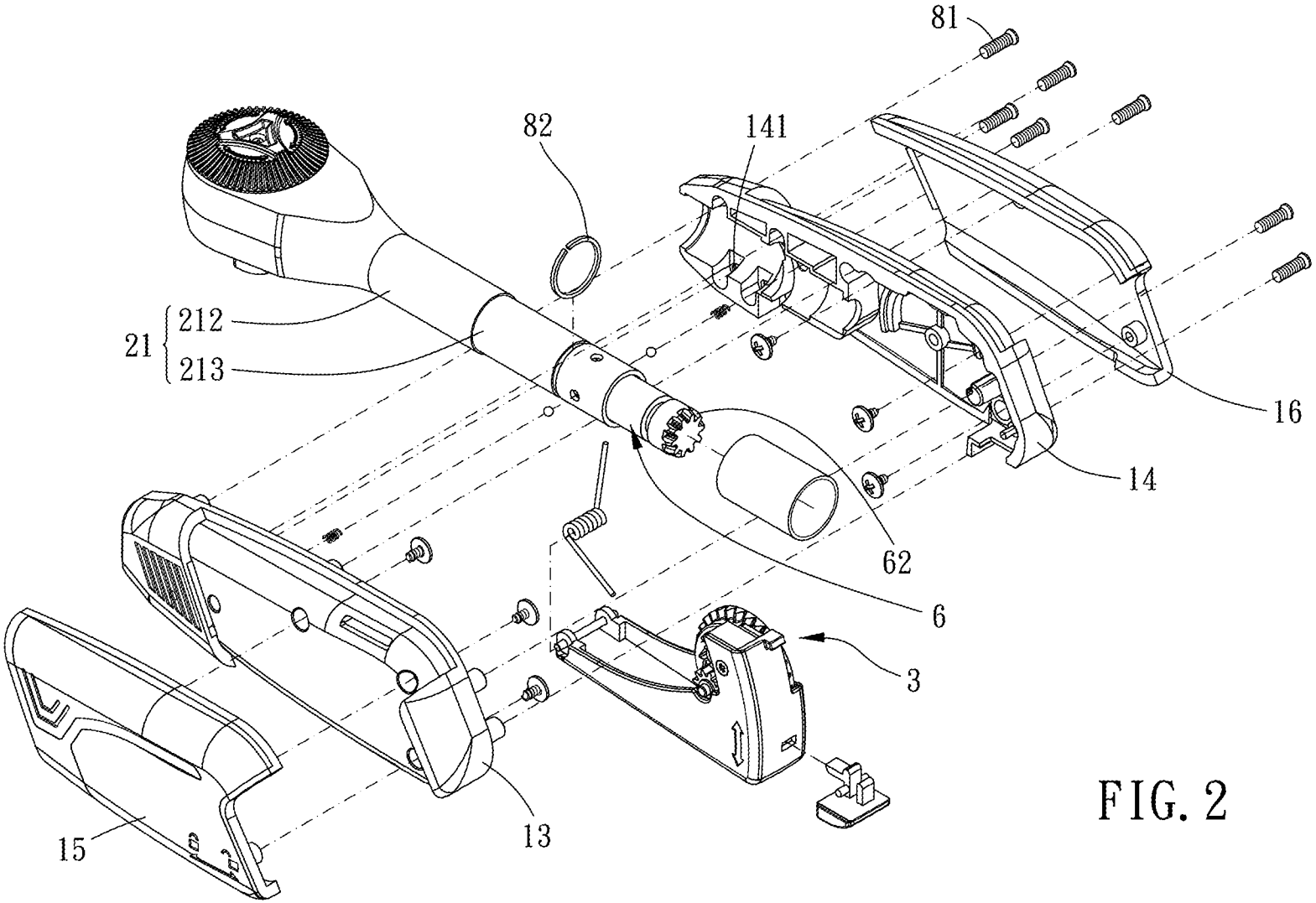
FIG. 2 is a partially breakdown view of the first embodiment of the present invention.
Figure 3:
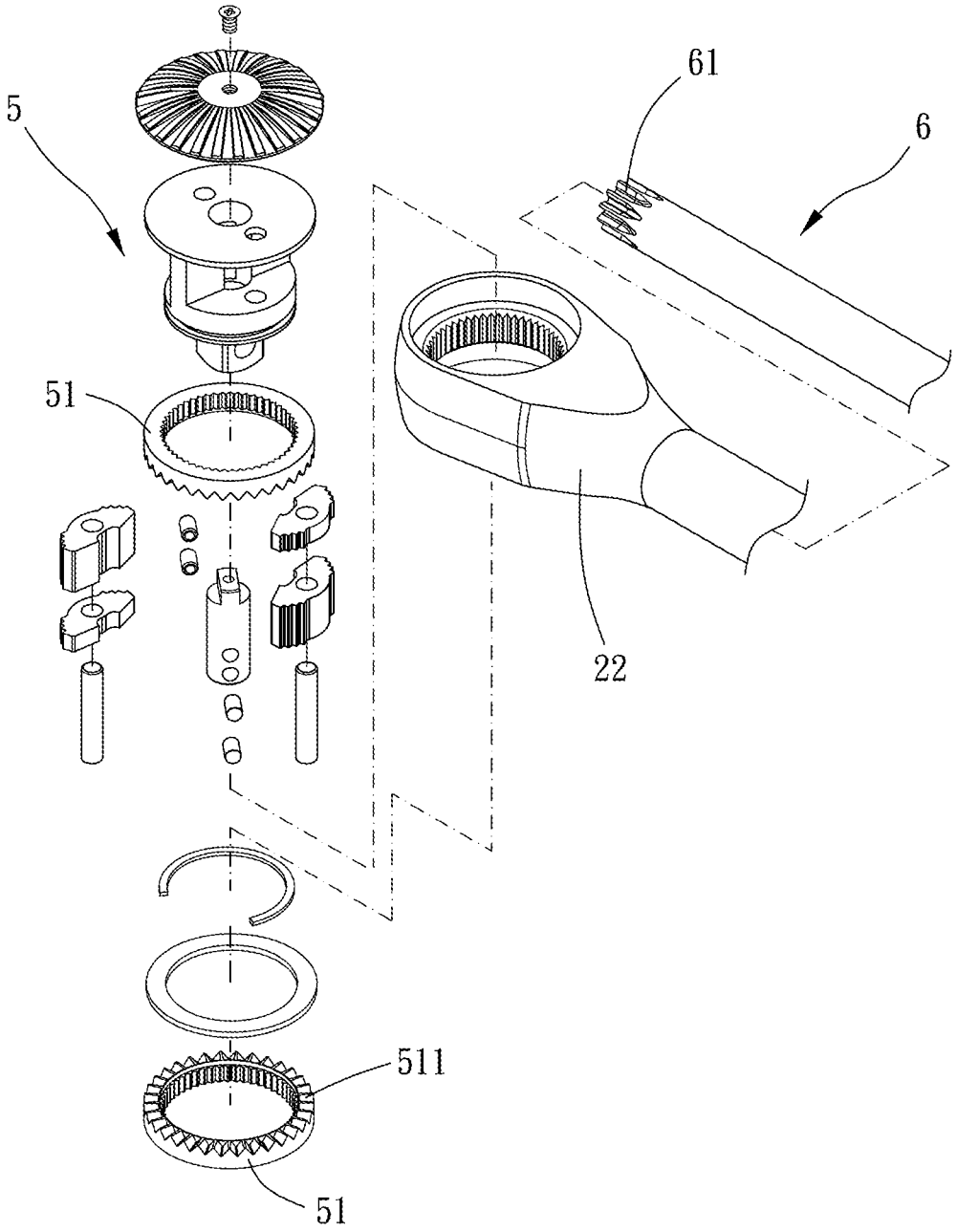
FIG. 3 is another partially breakdown view of the first embodiment of the present invention.
Figure 4:
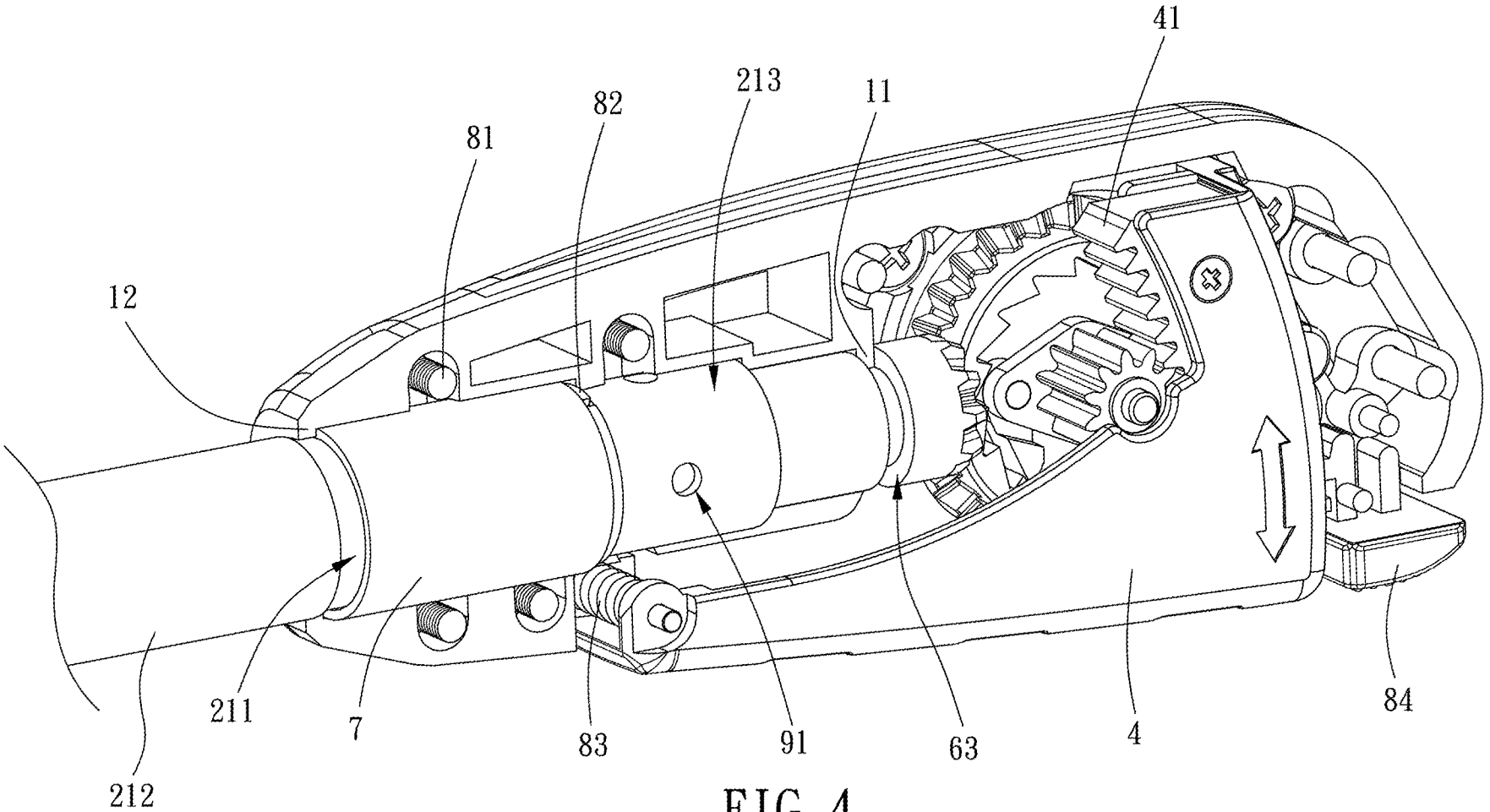
FIG. 4 is a partial stereogram of the first embodiment of the present invention.
Figure 5:
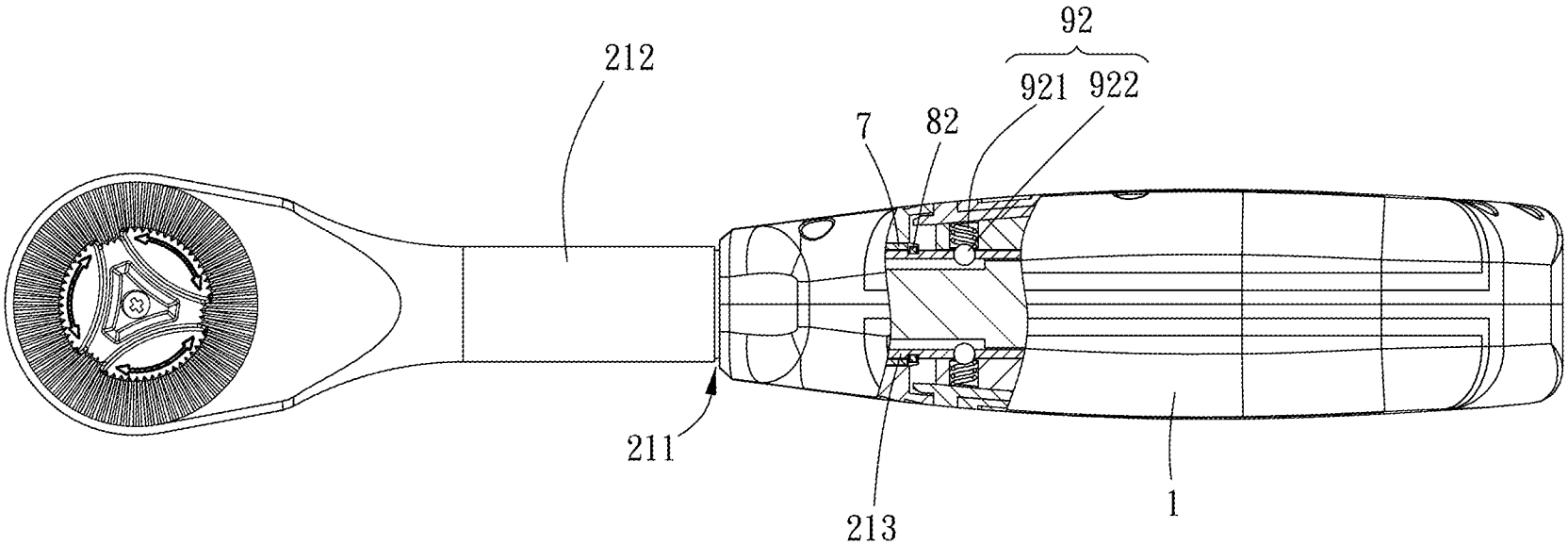
FIG. 5 is a partially cross-sectional view of the first embodiment of the present invention.

The present invention will be clearer from the following description when viewed together with the accompanying drawings, which show, for purpose of illustrations only, the preferred embodiment in accordance with the present invention.

Please refer to FIGS. 1 to 9 for a first embodiment. A driving tool includes a grip body 1, a main body 2, a driving assembly 3, a press handle 4, a driven assembly 5 and a toothed bar 6.

The main body 2 is rotatably disposed on the grip body 1, the main body 2 includes a body portion 21 and a head portion 22 which is connected to the body portion 21, the main body 2 and the grip body 1 are configured to be exterior shell assemblies which allow other components to be assembled thereto, and the main body 2 and the grip body 1 are rotatable relative to each other, so the driving tool can meet different needs in actual use.

The driving assembly 3 is received within the grip body 1, the driving assembly 3 includes a first driving member 31, a second driving member 32 and an unidirectional rotating structure 33, the first driving member 31 has a first driving toothed portion 311 which is annular, the second driving member 32 has a second driving toothed portion 321 which is annular, the first driving member 31 and the second driving member 32 are rotatably and coaxially arranged in the grip body 1, and the first driving member 31 is connected to the second driving member 32 via the unidirectional rotating structure 33, when the first driving member 31 rotates in a rotation direction, the second driving member 32 can be driven to rotate via the unidirectional rotating structure 33, when the first driving member 31 rotates in a direction counter to the rotation direction, the second driving member 32 is not driven to rotate synchronously via the unidirectional rotating structure 33.

The driven assembly 5 includes at least one driven member 51, the at least one driven member 51 has a driven toothed portion 511 which is annular, and the at least driven member 51 is rotatably disposed in the head portion 22. The at least one driven member 51 is designed to be a hollow ring which can be sleeved on a fastener (for example, a nut) to be rotated; or as shown in the first embodiment, a tool head can be assembled to the at least one driven member 51 to be in a co-rotation relationship, and the user may insert the tool head to the fastening tool (for example, a sleeve) to drive different types of fasteners to rotate.

The toothed bar 6 is disposed through the body portion 21, two opposite ends of the toothed bar 6 respectively project into the head portion 22 and the grip body 1, the two opposite ends of the toothed bar 6 respectively have a first transmitting toothed portion 61 and a second transmitting toothed portion 62 which are annular, the first transmitting toothed portion 61 is meshed with the driven toothed portion 511 of the at least one driven member 51, and the second transmitting toothed portion 62 is meshed with the second driving toothed portion 321 of the second driving member 32. In other words, the toothed bar 6 is configured to be a transmitting component to transmit a power, which is produced by the rotation of the second driving member 32 in the grip body 1, to the at least one driven member 51 of the head portion 22.

The press handle 4 is movably disposed on the grip body 1, the press handle 4 includes a driven toothed row 41, and the driven toothed row 41 is meshed with the first driving toothed portion 311 of the first driving member 31 so as to drive the first driving member 31 to rotate through a movement of the press handle 4. In the first embodiment, the press handle 4 is swingably disposed on the grip body 1, an elastic member 83 abuts against and between the press handle 4 and the grip body 1, and the elastic member 83 normally drives the press handle 4 to normally project beyond the grip body 1 for the user to press to drive the first driving member 31.

Figure 6:
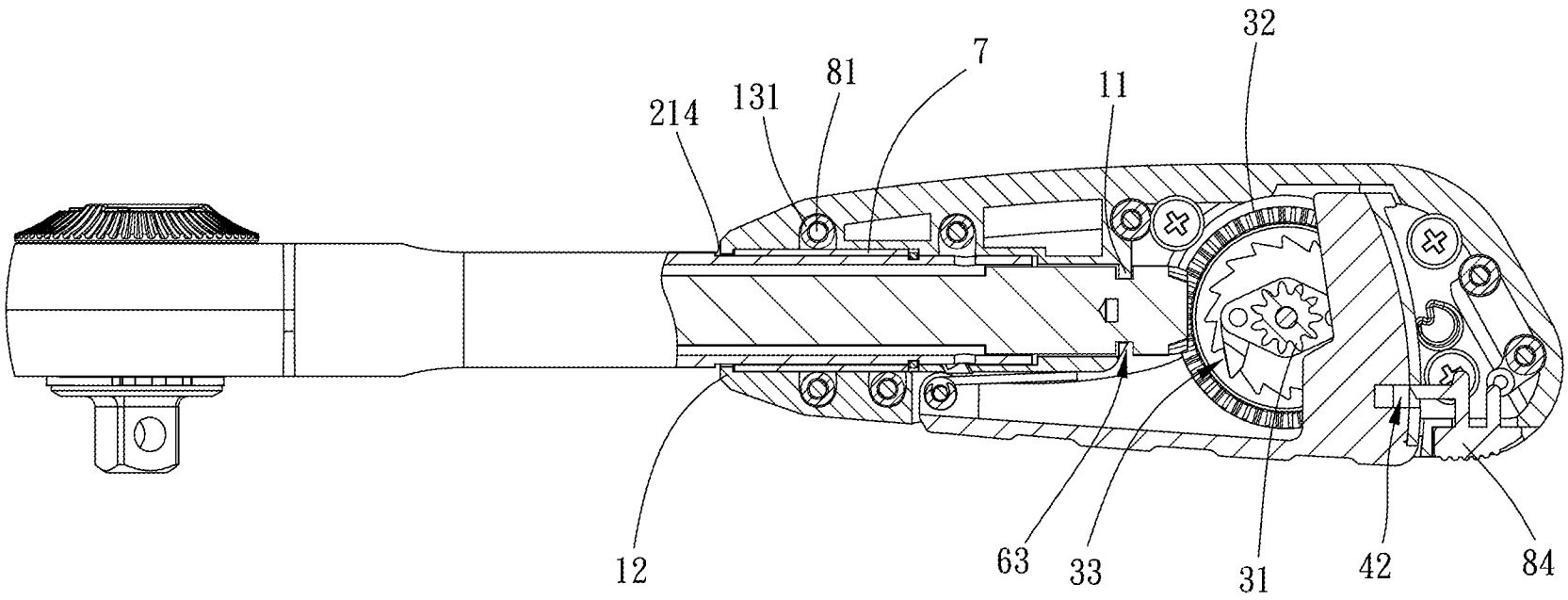
FIGS. 6 and 7 are drawings showing a main body of the first embodiment of the present invention in rotation.
Figure 7:
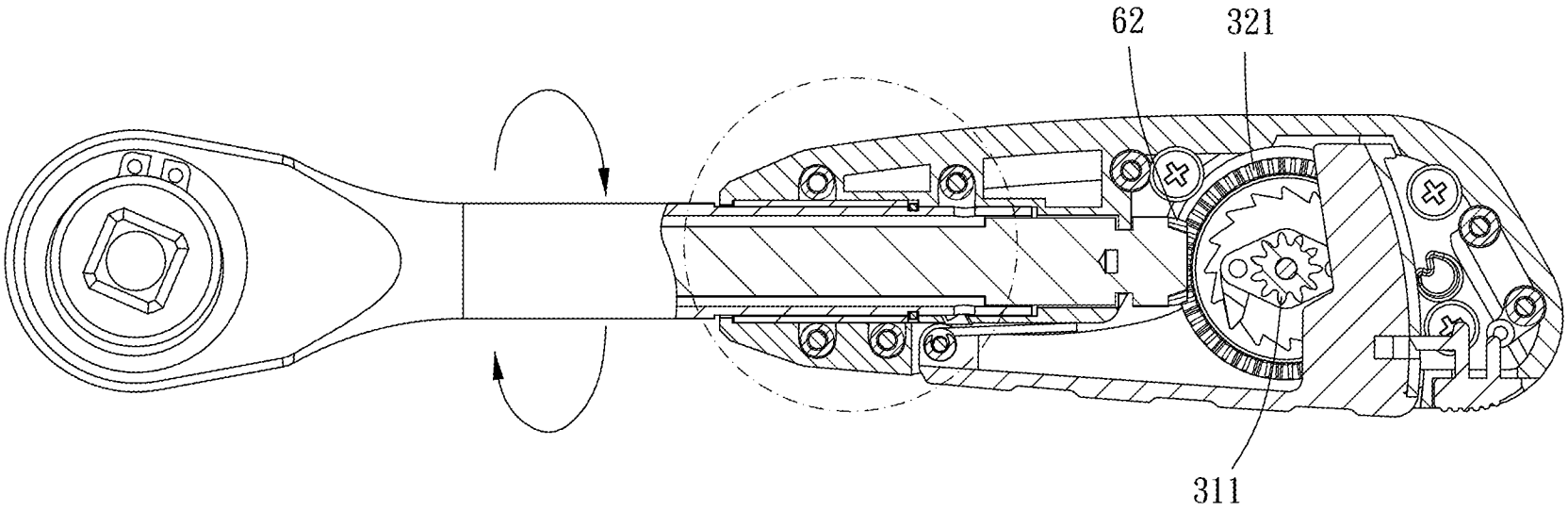
Figure 8:
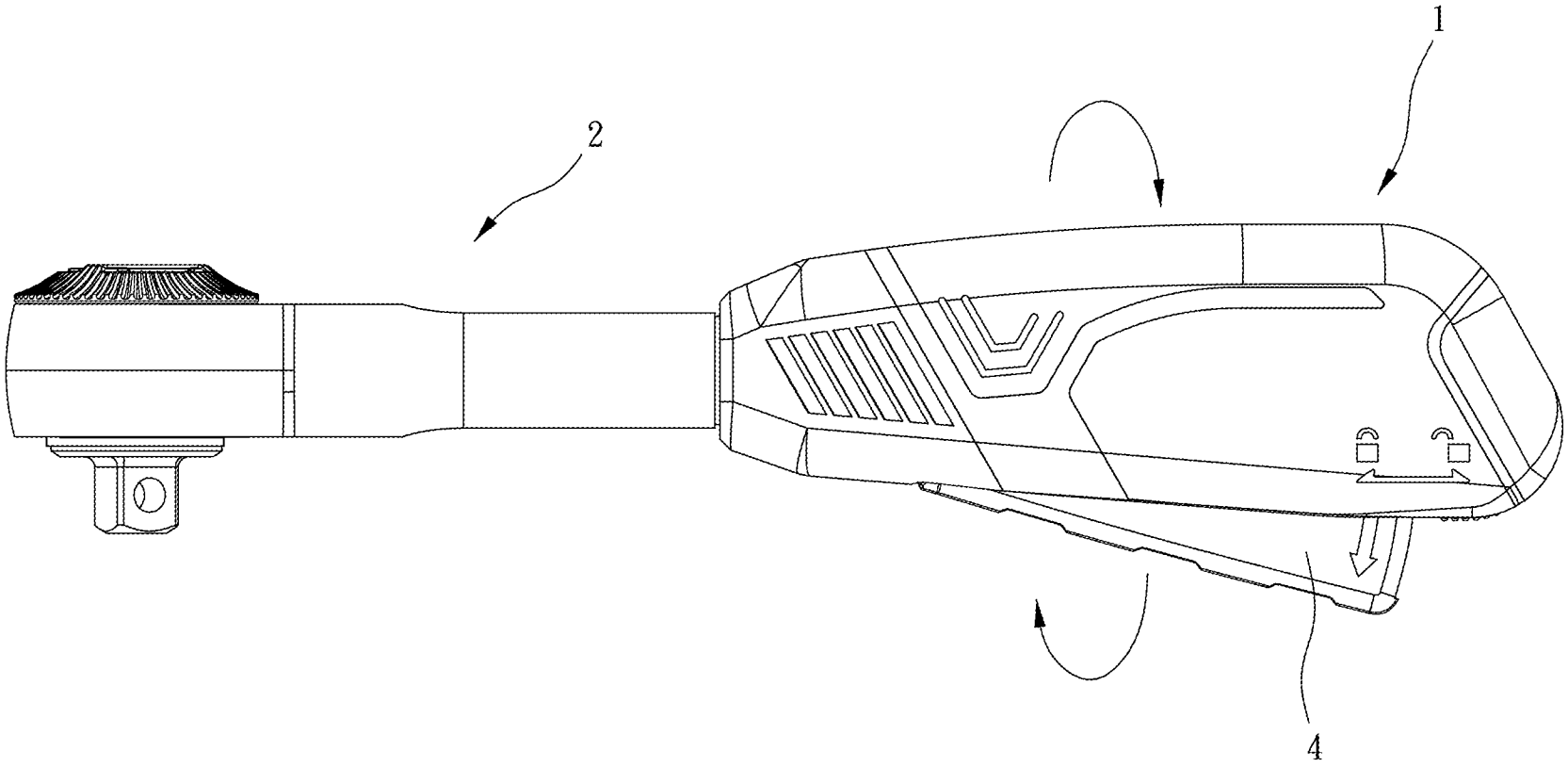
FIGS. 8 and 9 are drawings showing a grip body of the first embodiment of the present invention in rotation.
Figure 9:
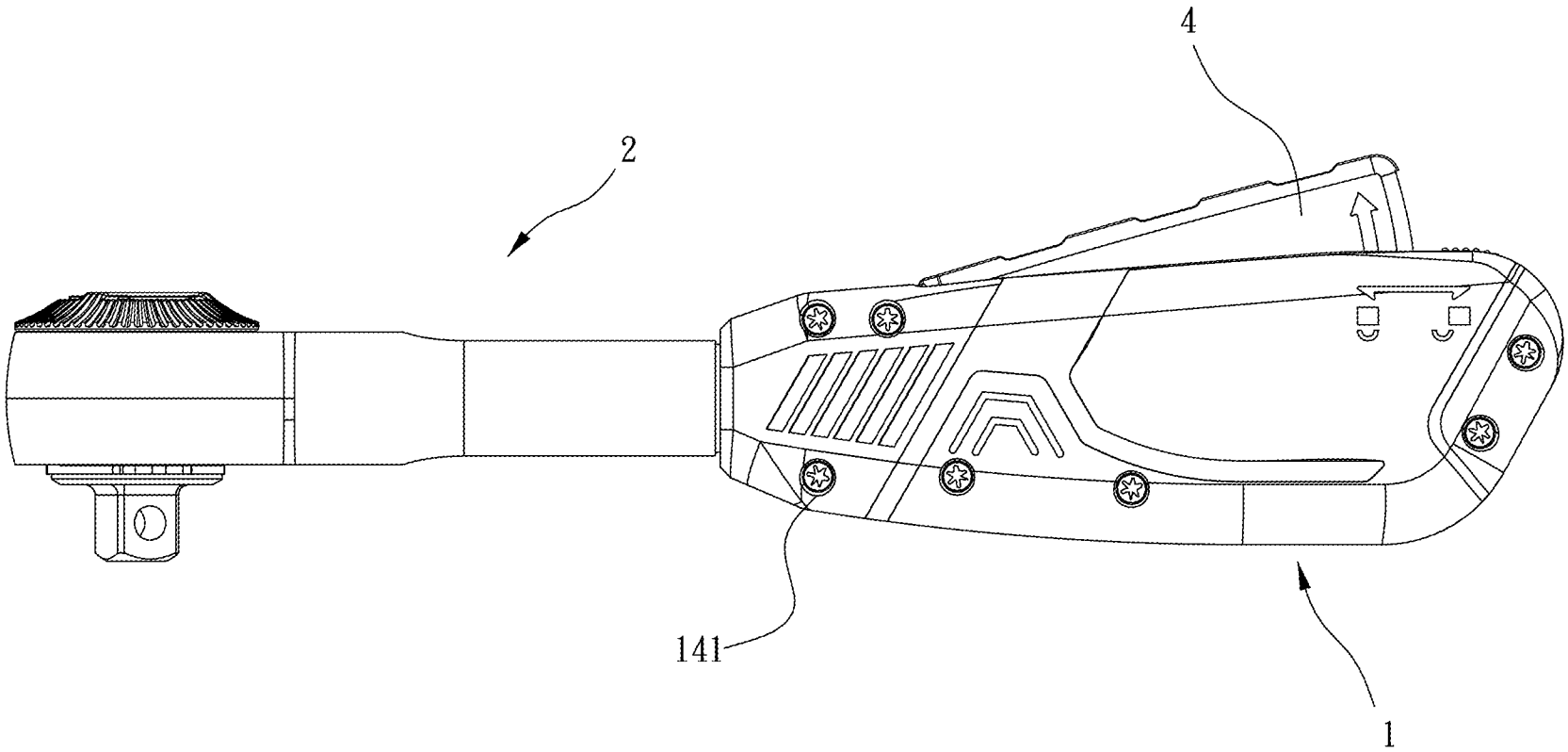

It is to be noted that as shown in FIGS. 6 and 7, when a plurality of fasteners in different positions need to be screwed, if the user wants to press the press handle 4 with the same position because of surrounding environments or usage habits, s/he only needs to rotate the main body 2. Or as shown in FIGS. 8 and 9, the dominant hand of the users may be different (left hand or right hand), so when the users press the press handle 4 with their dominant hand, pressing directions are opposite. At this moment, the user can rotate the grip body 1 to rotate the press handle 4 to a position where s/he can press the press handle 4 with his/her dominant hand easily, for example, rotating the press handle 4 on a right side to a left side. From this example, it is clear to see that the main body 2 and the grip body 1 which are rotatable relative to each other can meet different needs of the users.

Preferably, a locking member 84 is movably disposed on the grip body 1, the locking member 84 is insertable into a locking hole 42 of the press handle 4, and the locking member 84 is capable of blocking and positioning the press handle 4. When not being used, the locking member 84 can lock the press handle 4 which is kept in the grip body 1 to safely keep the press handle 4 and prevent from accidentally pressing the press handle 4.

The driving tool further includes a plurality of first positioning assemblies 91 and at least one second positioning assembly 92, one of the plurality of first positioning assemblies 91 and the at least one positioning assembly 92 is disposed in the body portion 21, the other of the plurality of first positioning assemblies 91 and the at least one positioning assembly 92 is disposed in the grip body 1, and the at least one second positioning assembly 92 is releasably engaged with one of the plurality of first positioning assemblies 91 to keep the main body 2 and the grip body 1 in their relative positions. In the first embodiment, the driving tool has four said first positioning assemblies 91, each of the plurality of first positioning assemblies 91 is an embedded hole, the plurality of first positioning assemblies 91 are annularly arranged on an end of the body portion 21 projecting into the grip body 1 equiangularly, the driving tool has two said second positioning assemblies 92 which are respectively and symmetrically positioned in the grip body 1, each said second positioning assembly 92 includes a spring 921 and a ball 922, the spring 921 abuts against and between the grip body 1 and the ball 922, the spring 921 is configured to drive the ball 922 to move toward the body portion 21, and the ball 922 is embeddable into one said first positioning assembly 91.

The grip body 1 integrally extends to form at least one first embedded portion 11, an end of the toothed bar 6 projecting into the grip body 1 has a first ring ditch 63, and the at least one first embedded portion 11 is embedded into the first ring ditch 63 to allow the toothed bar 6 to be rotatably positioned in the grip body 1 so as to largely increase the stability of the transmission force of the toothed bar 6. The at least one first embedded portion 11 is designed as integrally extending from the grip body 1 to have a continuous and strong structure, and this design can effectively help decrease the components needed and simplify the assembling process.

The driving tool further has a reinforcing sleeve 7, the reinforcing sleeve 7 is sleeved on an inserting section 213 of the body portion 21, the reinforcing sleeve 7 and the inserting section 213 are both received in the grip body 1, and an end of the toothed bar 6 projects beyond the inserting section 213 to be meshed with the second driving toothed portion 321 via the second transmitting portion 62; the reinforcing sleeve 7 is positioned in the grip body 1, and the inserting section 213 is rotatable relative to the reinforcing sleeve 7. When the user use the driving tool in a traditional way (grip on the grip body 1 to pull), the reinforcing sleeve 7 can effectively distribute a force from the grip body 1 evenly to protect the inserting section 213 inside.

Preferably, the reinforcing sleeve 7 is made of metal to provide better structure strength and smoothness for relative rotation.

In the first embodiment, the body portion 21 includes an exposed section 212 and the insertion section 213 which is connected to the exposed section 212, the exposed section 212 projects beyond the grip body 1, the exposed section 212 is greater than the inserting section 213 in radial dimension to form a stepped portion 214, a block ring 82 is clipped on the inserting section 213, is distanced from the stepped portion 214 and abuts against the grip body 1, the reinforcing sleeve 7 and the stepped portion 214 have a distance therebetween to form a second ring ditch 211, the grip body 1 further includes at least one second embedded portion 12, and the at least one second embedded portion 12 is embedded into the second ring ditch 211 to clipped on and positioned the reinforcing sleeve 7 with the block ring 82.

Figure 10:
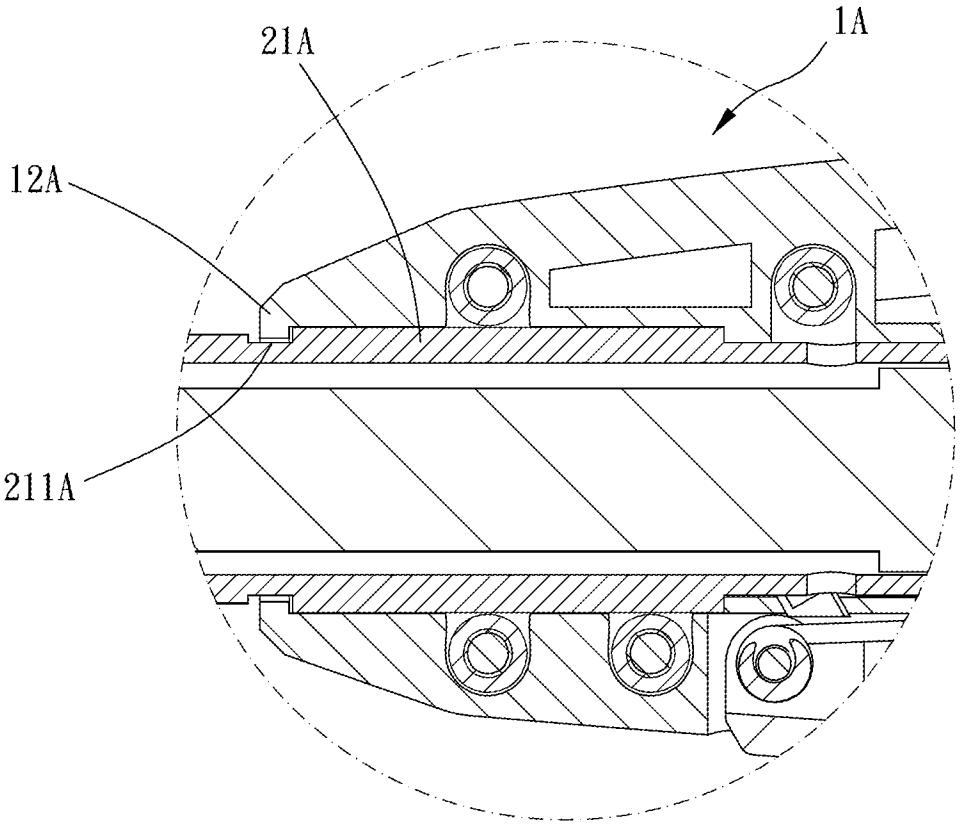
FIG. 10 is a partially cross-sectional view of a second embodiment of the present invention.

The driving tool may be in another structure as a second embodiment shown in FIG. 10. The grip body 1A further has at least one second embedded portion 12A, the body portion 21A has a second ring ditch 211A, and the at least one second embedded portion 12A is embedded into the second ring ditch 211A to allow the body portion 21A to be rotatably positioned in the grip body 1A.

Please further refer to FIGS. 1 to 9 for the first embodiment. Specifically, the grip body 1 further includes a first shell 13 and a second shell 14, the first shell 13 includes a plurality of joint poles 131, the second shell 14 includes a plurality of through holes 141, positions of the plurality of through holes 141 correspond to positions of the plurality of joint poles 131, a plurality of screws 81 are respectively disposed through the plurality of through holes 141 to be connected to the plurality to joint poles 131, and the first shell 13 and the second shell 14 are assembled to each other to form the grip body 1; the plurality of joint poles 131 are respectively located by two opposite sides of the reinforcing sleeve 7. In this embodiment, the reinforcing sleeve 7 is sandwiched by two of the plurality of joint poles 131 which are symmetrically arranged, so the reinforcing sleeve 7 and the grip body 1 are engaged with each other more tightly to transmit and distribute the force more effectively.

Preferably, the first shell 13 and the second shell 14 are respectively made of aluminum alloy for the benefits of light weight and strong structure strength.

More preferably, the driving tool further includes a first plastic shell 15 and a second plastic shell 16, the first plastic shell 15 covers a part of the first shell 13, and the second plastic shell 16 covers a part of the second shell 14 to ensure a preferable gripping comfort.

Given the above, the driving tool can be pressed to drive the driven member to rotate, and the main body is rotatable relative to the grip body, so the user can adjust the position where the head portion faces or adjust the angle of the press handle according to different requirements.

While we have shown and described various embodiments in accordance with the present invention, it should be clear to those skilled in the art that further embodiments may be made without departing from the scope of the present invention.

What is claimed is:

1. A driving tool, including:

a grip body;

a main body, rotatably disposed on the grip body, the main body including a body portion and a head portion which is connected to the body portion;

a driving assembly, received within the grip body, the driving assembly including a first driving member, a second driving member and an unidirectional rotating structure, the first driving member having a first driving toothed portion which is annular, the second driving member having a second driving toothed portion which is annular, the first driving member and the second driving member being rotatably and coaxially arranged in the grip body, the first driving member being connected to the second driving member via the unidirectional rotating structure, when the first driving member rotates in a rotation direction, the second driving member is driven to rotate via the unidirectional rotating structure, when the first driving member rotates in a direction counter to the rotation direction, the second driving member is not driven to rotate synchronously via the unidirectional rotating structure;

a driven assembly, including at least one driven member, the at least one driven member having a driven toothed portion which is annular, the at least driven member being rotatably disposed in the head portion;

a toothed bar, disposed through the body portion, two opposite ends of the toothed bar respectively projecting into the head portion and the grip body, the two opposite ends of the toothed bar respectively having a first transmitting toothed portion and a second transmitting toothed portion which are annular, the first transmitting toothed portion being meshed with the driven toothed portion of the at least one driven member, the second transmitting toothed portion being meshed with the second driving toothed portion of the second driving member;

a press handle, movably disposed on the grip body, the press handle including a driven toothed row, the driven toothed row being meshed with the first driving toothed portion of the first driving member so as to drive the first driving member to rotate through a movement of the press handle;

wherein the grip body integrally extends to form at least one first embedded portion, an end of the toothed bar projecting into the grip body has a first ring ditch, and the at least one first embedded portion is embedded into the first ring ditch to allow the toothed bar to be rotatably positioned in the grip body.

2. The driving tool of claim 1, further including a plurality of first positioning assemblies and at least one second positioning assembly, one of the plurality of first positioning assemblies and the at least one positioning assembly being disposed in the body portion, the other of the plurality of first positioning assemblies and the at least one positioning assembly being disposed in the grip body, the at least one second positioning assembly being releasably engaged with one of the plurality of first positioning assemblies.

3. The driving tool of claim 2, wherein each of the plurality of first positioning assemblies is an embedded hole, the plurality of first positioning assemblies are annularly arranged on an end of the body portion projecting into the grip body equiangularly, the driving tool has two said second positioning assemblies which are respectively and symmetrically positioned in the grip body, each said second positioning assembly includes a spring and a ball, the spring abuts against and between the grip body and the ball, the spring is configured to drive the ball to move toward the body portion, and the ball is embeddable into one said first positioning assembly.

4. A driving tool, including:

a grip body;

a main body, rotatably disposed on the grip body, the main body including a body portion and a head portion which is connected to the body portion;

a driving assembly, received within the grip body, the driving assembly including a first driving member, a second driving member and an unidirectional rotating structure, the first driving member having a first driving toothed portion which is annular, the second driving member having a second driving toothed portion which is annular, the first driving member and the second driving member being rotatably and coaxially arranged in the grip body, the first driving member being connected to the second driving member via the unidirectional rotating structure, when the first driving member rotates in a rotation direction, the second driving member is driven to rotate via the unidirectional rotating structure, when the first driving member rotates in a direction counter to the rotation direction, the second driving member is not driven to rotate synchronously via the unidirectional rotating structure;

a driven assembly, including at least one driven member, the at least one driven member having a driven toothed portion which is annular, the at least driven member being rotatably disposed in the head portion;

a toothed bar, disposed through the body portion, two opposite ends of the toothed bar respectively projecting into the head portion and the grip body, the two opposite ends of the toothed bar respectively having a first transmitting toothed portion and a second transmitting toothed portion which are annular, the first transmitting toothed portion being meshed with the driven toothed portion of the at least one driven member, the second transmitting toothed portion being meshed with the second driving toothed portion of the second driving member;

a press handle, movably disposed on the grip body, the press handle including a driven toothed row, the driven toothed row being meshed with the first driving toothed portion of the first driving member so as to drive the first driving member to rotate through a movement of the press handle;

wherein the grip body further includes at least one second embedded portion, the body portion has a second ring ditch, and the at least one second embedded portion is embedded into the second ring ditch to allow the body portion to be rotatably positioned in the grip body.

5. A driving tool, further having including:

a grip body;

a main body, rotatably disposed on the grip body, the main body including a body portion and a head portion which is connected to the body portion;

a driving assembly, received within the grip body, the driving assembly including a first driving member, a second driving member and an unidirectional rotating structure, the first driving member having a first driving toothed portion which is annular, the second driving member having a second driving toothed portion which is annular, the first driving member and the second driving member being rotatably and coaxially arranged in the grip body, the first driving member being connected to the second driving member via the unidirectional rotating structure, when the first driving member rotates in a rotation direction, the second driving member is driven to rotate via the unidirectional rotating structure, when the first driving member rotates in a direction counter to the rotation direction, the second driving member is not driven to rotate synchronously via the unidirectional rotating structure;

a driven assembly, including at least one driven member, the at least one driven member having a driven toothed portion which is annular, the at least driven member being rotatably disposed in the head portion;

a toothed bar, disposed through the body portion, two opposite ends of the toothed bar respectively projecting into the head portion and the grip body, the two opposite ends of the toothed bar respectively having a first transmitting toothed portion and a second transmitting toothed portion which are annular, the first transmitting toothed portion being meshed with the driven toothed portion of the at least one driven member, the second transmitting toothed portion being meshed with the second driving toothed portion of the second driving member;

a press handle, movably disposed on the grip body, the press handle including a driven toothed row, the driven toothed row being meshed with the first driving toothed portion of the first driving member so as to drive the first driving member to rotate through a movement of the press handle;

a reinforcing sleeve, the reinforcing sleeve being sleeved on an inserting section of the body portion, the reinforcing sleeve and the inserting section being both received in the grip body, an end of the toothed bar projecting beyond the inserting section to be meshed with the second driving toothed portion via the second transmitting portion; wherein the reinforcing sleeve is positioned in the grip body, and the inserting section is rotatable relative to the reinforcing sleeve.

6. The driving tool of claim 5, wherein the grip body further includes a first shell and a second shell, the first shell includes a plurality of joint poles, the second shell includes a plurality of through holes, positions of the plurality of through holes correspond to positions of the plurality of joint poles, a plurality of screws are respectively disposed through the plurality of through holes to be connected to the plurality to joint poles, and the first shell and the second shell are assembled to each other to form the grip body; the plurality of joint poles are respectively located by two opposite sides of the reinforcing sleeve.

7. The driving tool of claim 6, wherein the reinforcing sleeve is sandwiched by two of the plurality of joint poles which are symmetrically arranged.

8. The driving tool of claim 5, wherein the body portion includes an exposed section and the insertion section which is connected to the exposed section, the exposed section projects beyond the grip body, the exposed section is greater than the inserting section in radial dimension to form a stepped portion, a block ring is clipped on the inserting section, is distanced from the stepped portion and abuts against the grip body, the reinforcing sleeve and the stepped portion have a distance therebetween to form a second ring ditch, the grip body further includes at least one second embedded portion, and the at least one second embedded portion is embedded into the second ring ditch to clipped on and positioned the reinforcing sleeve with the block ring.

9. The driving tool of claim 8, wherein the grip body integrally extends to form at least one first embedded portion, an end of the toothed bar projecting into the grip body has a first ring ditch, and the at least one first embedded portion is embedded into the first ring ditch to allow the toothed bar to be rotatably positioned in the grip body; the grip body further includes a first shell and a second shell, the first shell includes a plurality of joint poles, the second shell includes a plurality of through holes, positions of the plurality of through holes correspond to positions of the plurality of joint poles, a plurality of screws are respectively disposed through the plurality of through holes to be connected to the plurality to joint poles, and the first shell and the second shell are assembled to each other to form the grip body; the plurality of joint poles are respectively located by two opposite sides of the reinforcing sleeve; the reinforcing sleeve is sandwiched by two of the plurality of joint poles which are symmetrically arranged; the driving tool further includes a plurality of first positioning assemblies and at least one second positioning assembly, one of the plurality of first positioning assemblies and the at least one positioning assembly is disposed in the body portion, the other of the plurality of first positioning assemblies and the at least one positioning assembly is disposed in the grip body, and the at least one second positioning assembly is releasably engaged with one of the plurality of first positioning assemblies; each of the plurality of first positioning assemblies is an embedded hole, the plurality of first positioning assemblies are annularly arranged on an end of the body portion projecting into the grip body equiangularly, the driving tool has two said second positioning assemblies which are respectively and symmetrically positioned in the grip body, each said second positioning assembly includes a spring and a ball, the spring abuts against and between the grip body and the ball, the spring is configured to drive the ball to move toward the body portion, and the ball is embeddable into one said first positioning assembly; the first shell and the second shell are respectively made of aluminum alloy; the driving tool further includes a first plastic shell and a second plastic shell, the first plastic shell covers a part of the first shell, and the second plastic shell covers a part of the second shell; the driving tool has four said first positioning assemblies; the press handle is swingably disposed on the grip body, an elastic member abuts against and between the press handle and the grip body, and the elastic member normally drives the press handle to normally project beyond the grip body; a locking member is movably disposed on the grip body, the locking member is insertable into a locking hole of the press handle, and the locking member is capable of blocking and positioning the press handle; a tool head is assembled to the at least one driven member to be in a co-rotation relationship; the reinforcing sleeve is made of metal.

* * * * *